United States Patent [19]

Lucas, Jr.

[11] 3,938,451

[45] Feb. 17, 1976

[54] GASIFIER CHARGING SYSTEM

[75] Inventor: Theodore W. Lucas, Jr., Williamsville, N.Y.

[73] Assignee: Andco Incorporated, Buffalo, N.Y.

[22] Filed: Jan. 3, 1975

[21] Appl. No.: 538,344

[52] U.S. Cl. ..... 110/109; 214/17 D; 214/18 R; 214/18 V

[51] Int. Cl.[2] ..... F23K 3/16

[58] Field of Search ..... 110/109, 116; 214/17 D, 214/18 R, 18 V

[56] References Cited

UNITED STATES PATENTS

| | | | |
|---|---|---|---|
| 2,912,941 | 11/1959 | Hughes et al. | 110/109 X |
| 3,064,593 | 11/1962 | Burk et al. | 110/116 X |
| 3,457,882 | 7/1969 | Ruzika | 110/109 X |
| 3,680,719 | 8/1972 | Reilly | 214/17 |
| 3,742,875 | 7/1973 | Eberle | 110/116 |

*Primary Examiner*—Kenneth W. Sprague
*Attorney, Agent, or Firm*—Christel & Bean

[57] ABSTRACT

A refuse feeder and charging system is provided for a solid waste destruction system wherein a high temperature disposal of waste materials occurs. In such a destruction system, waste materials must be fed or charged to the upper end of a vertical gasification chamber from which the waste materials move downwardly under the force of gravity as the combustible materials are converted to molten slag and resultant gases and vapors. The refuse feeder includes a storage hopper for uniformly feeding solid waste material contained therein to a conduit means which conveys the waste material to the aforesaid gasification chamber. The storage hopper further includes an inclined vibrating pan in the bottom thereof for facilitating the uniform conveyance of waste material to the conduit means and a first set of sealing doors which may be opened and closed for purposes of batch filling the storage hopper. The refuse feeder or charging system additionally includes a second set of sealing doors disposed between the storage hopper and the conduit means which normally open only during conveyance of waste material to the conduit means. The combination of the first and second set of sealing doors insures the sealing of the charging system from the ambient atmosphere so that a minimum amount of external air is entrained in the waste material fed to the destruction system. A third set of doors is provided on the conduit means which serves as an alternative method of feeding waste material directly into the conduit means and gasification chamber should the storage hopper and first and second set of doors be out of service for any reason. The third set of doors also provides a mechanism for pressure release should an explosion of any sort take place within the gasification chamber and connected conduit means thereby protecting the system from structural damage.

8 Claims, 4 Drawing Figures

GASIFIER CHARGING SYSTEM

BACKGROUND OF THE INVENTION

This invention relates generally to a refuse feeder or charging system for a solid waste destruction system, and more particularly to a refuse feeder which is capable of uniformly charging solid waste material into the furnace portion of the destruction system. In addition, the refuse feeder of the present invention provides a charging system which is sealed from the outside atmosphere so that minimum outside air is entrained during the charging process.

The disposing of waste materials is a severe problem at the present time, due to the great variety and quantity of materials that must be disposed of, necessitating a highly flexible system which must be adapted in its operation to meet the most limitless compositional variety and quantity of waste material, while at the same time meeting all the existing and expected governmental policy requirements with respect to air and water pollution control.

Modern technology has generated a vast but anticipated quantity and variety of waste products and it is intended that the present invention will lend itself to means for disposing of this waste product in a rapid and efficient manner notwithstanding changes in composition of waste products which are bound to occur from time to time during the operation of the present invention. Due to the large volume of waste materials that must be handled, particularly in regions of high population density, substantially the only feasible manner of processing and disposing of waste materials is by combustion, landfill and open dumping. By far the most efficient and desirable of these methods is high temperature disposal if such can be carried out in a manner so that the products thereof are completely combusted.

For the disposing of waste materials by high temperature combustion, different types of apparatus have been developed in the prior art such as conventional grate-type incinerators and more modern shaft-type pyrolysis systems. Typically waste materials are fed or charged into the upper end of a vertical gasification chamber from which the materials move downwardly under the force of gravity as the combustible materials therebeneath are converted to gases, vapors, distillate, and molten slag. A preheated hot air blast together with the combustibles develops heat sufficient to produce a flame temperature which will melt glass, metals and the like so as to reduce the metals, glass etc. to a molten condition. Gaseous and vaporous byproducts may be withdrawn and mixed with additional air and completely burned in a secondary combustion chamber, and then passed through a waste heat boiler for extraction of thermal energy and finally through a particulate separation system before venting to the outside atmosphere.

In the solid waste combustion furnaces and destruction systems resulting from newer technology, the amounts of excess air required in the furnace has been reduced so that it is necessary to provide a totally sealed system to prevent unknown volumes of air from being entrained within the furnace structure. In addition, as in all prior art combustion furnaces, it is critical and therefore highly desirable to include a means for uniformly feeding or charging solid waste into the combustion system.

SUMMARY OF THE INVENTION

Accordingly, one object of the present invention is to provide a refuse feeding and charging system which is completely sealed from atmospheric entrainment of air.

Another object of the present invention is to provide a refuse charging system for a solid waste destruction system in which waste materials may be slowly fed to the furnace or gasification chamber of the destruction system while not delaying cranes or conveyor mechanisms transporting waste materials to the site of the destruction system.

A further object of the present invention is to provide a refuse feeder including a storage hopper which may be "batch filled" with refuse while semi-continuously feeding such refuse from the storage hopper into a solid waste disposal system of any type.

Still another object of the present invention is to provide the aforesaid charging system which allows operation of a solid waste disposal furnace under any positive or negative internal pressures without leakage of toxic pollutants to the atmosphere.

A still further object of the present invention is to provide a charging system including pressure relief means for protecting against possible internal explosions in a solid waste disposal furnace.

An additional object of the present invention is to provide a charging system primarily designed to automatically feed solid waste materials to a disposal furnace but including alternative means for feeding such solid waste even though the automatic feeding portion of the system may be out of service.

In summary, the present invention provides a refuse feeder for solid waste destruction systems in which the feeder includes a storage hopper having a first and second set of sealing doors movable between open and closed positions. The first door means is opened only for loading of the storage hopper with waste materials and at other times is normally closed so as to seal the internal portion of the hopper from the ambient atmosphere. The second door means is disposed on a side portion of the storage hopper and opens to allow the conveyance of waste material from the hopper to a conduit means leading to the gasification chamber of the destruction system. The second door is normally closed when the hopper is being filled or not in use so as to insure sealing of the conduit means from the ambient atmosphere. A third sealing door is provided in a sidewall of the conduit means as an alternative means for feeding waste material to the furnace.

The foregoing and other objects, advantages and characterizing features of the present invention will become clearly apparent from the ensuing detailed description of the illustrative embodiment thereof taken together with the accompanying drawings wherein like reference characters denote like parts throughout the various views.

DETAILED DESCRIPTION OF A PREFERRED EMBODIMENT

Figure 1:
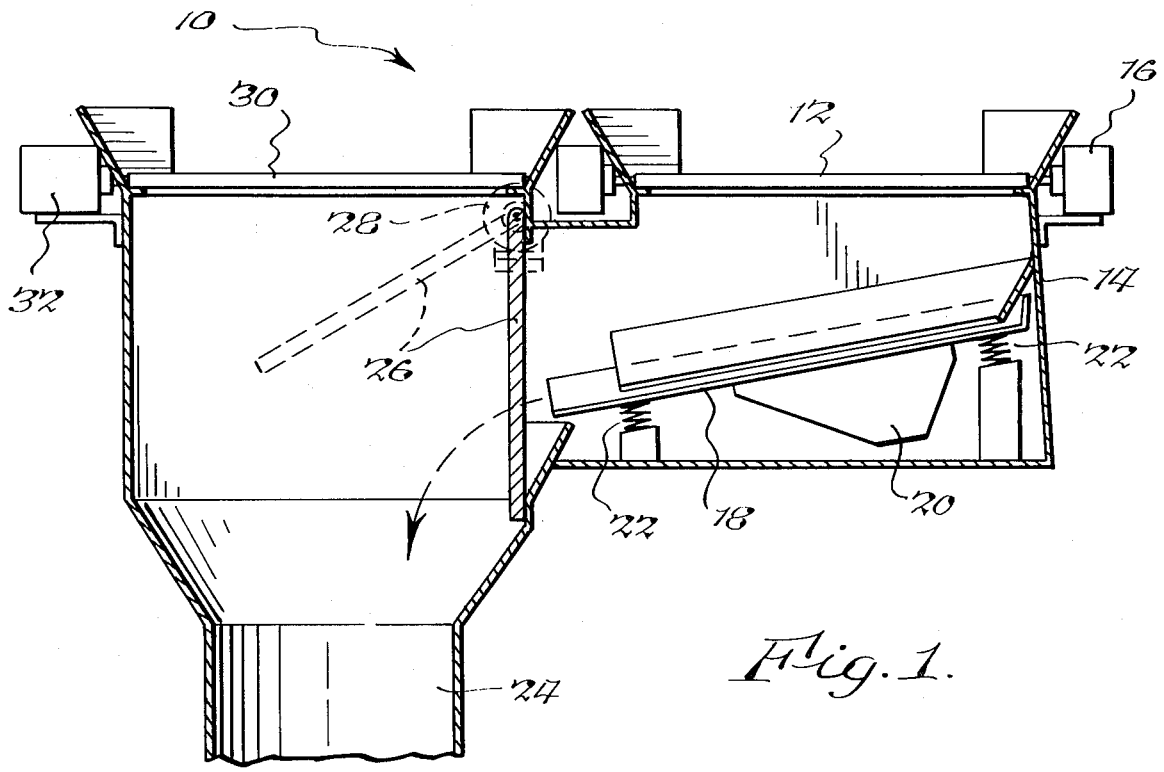
FIG. 1 is a side elevational view in section of the refuse feeder of this invention taken about on line 1—1 of FIG. 2.
Figure 2:
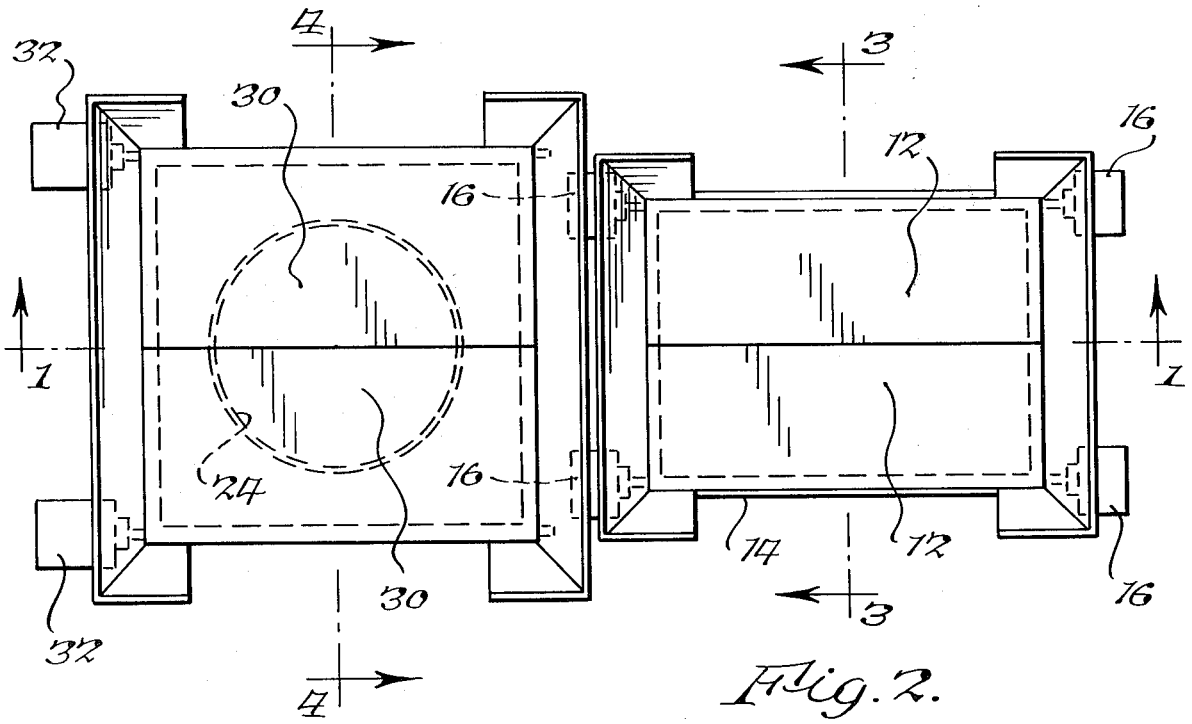
FIG. 2 is a top plan view of the apparatus constituting the present invention.
Figure 3:
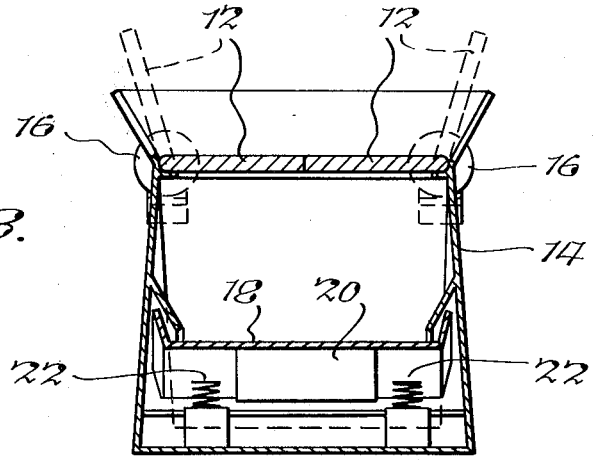
FIG. 3 is a transverse view in section of the storage hopper means of the feeder assembly as taken about on line 3—3 of FIG. 2.

Referring now in detail to the illustrative embodiment depicted in the accompanying drawings, there is shown in FIG. 1 a refuse feeder or charging apparatus for a solid waste destruction system, such feeder generally being indicated as 10. The feeder includes a first set of sealing door means 12 mounted on top of a storage hopper 14, the latter being provided to receive waste materials for conveyance to a solid waste destruction system. As seen in FIGS. 1 and 2, the first sealing doors 12 consist of two panels respectively pivoted or hinged about the side edges of the hopper 14. The two hinged panels of the first sealing doors are movable generally between an opened and closed position. A first drive means comprising the motor means 16 are connected to the door panels for operatively urging or moving the first set of doors 12 between the open and closed positions.

The storage hopper 14 further includes a pan means 18 and pan drive means 20. Pan means 18 is mounted on spring means 22 and through the connection with the pan drive means 20 oscillates or vibrates to slowly urge waste material contained therein from the storage hopper into a conduit means 24 adjacent to the bottom of the inclined surface of the pan means. The pan means 18, pan drive means 20 and spring mounting means 22 are known in the prior art. One type of such pan drive means 20 is a Jeffrey Feeder which operates on pulsating direct current produced by a metallic rectifier. Movement imparted to the pan means 18 results from the rotational movement of eccentric weights carried by the pan drive means.

Figure 4:
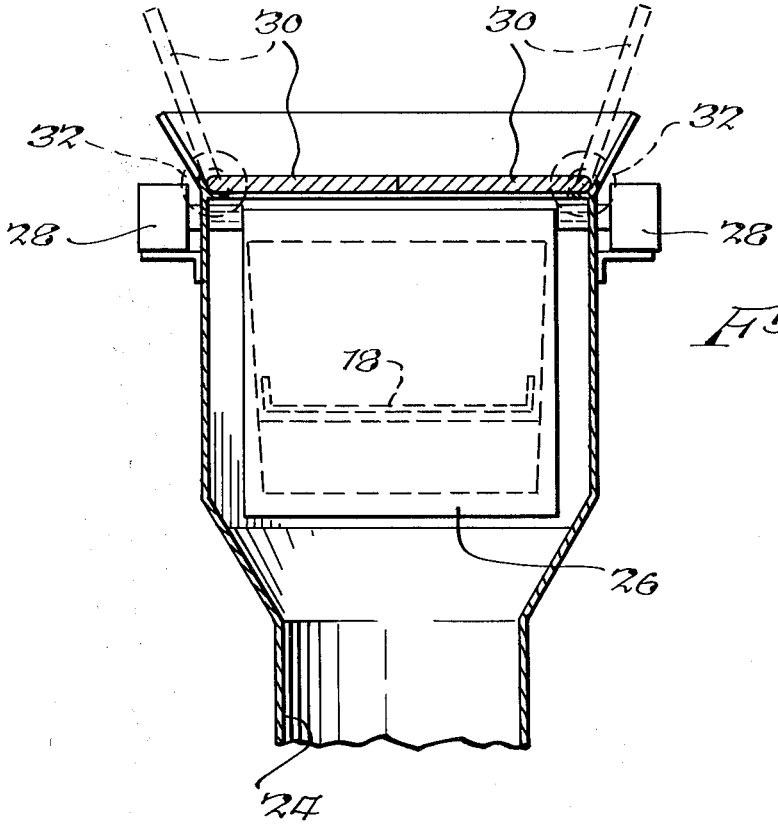
FIG. 4 is a transverse sectional view taken about on line 4—4 of FIG. 2 of the upper portion of the conduit means of the present invention.

A second sealing door means 26 is located intermediate to the storage hopper 14 and the conduit means 24. The second sealing door is hinged about its upper portion as shown in FIG. 1 and is movable from the closed position shown in FIG. 1 to the open position indicated in dotted lines in FIG. 1. The second sealing door is moved between its opened and closed positions by a second drive means 28 which is in driving connection with the door as shown in FIGS. 1 and 4. When the second door means is in a closed position, the communication between the storage hopper 14 in conduit means 24 is sealed off so that neither air nor waste materials will pass from the storage hopper into the conduit means, the latter leading to the gasification chamber of any one of the variety of solid waste destruction furnaces presently available.

A third sealing door 30 having two hinged portions is mounted on top of the conduit means as shown in FIGS. 1 and 4. The third sealing doors are also movable between a closed position shown in FIG. 4 and an open position as shown in dotted lines therein. The doors 30 are in driving connection with a third driving means 32 for driving the doors between the aforesaid open and closed positions. The third door means 30 can be utilized to feed waste materials directly into the conduit means 24 in the event that the storage hopper 14 and associated apparatus thereof become inoperable. Although ambient atmosphere would not be sealed off with respect to the conduit means 24 in such use of the doors 30, emergency loading of the conduit could still take place. In addition, the doors 30 also are provided to open in reaction to excessive internal pressure within the conduit means 24 which could result from an explosion of some sort taking place within the furnace shaft or gasification chamber of the destruction system. In such situations, the doors 30 would provide pressure release with respect to the system to protect against rupture of any one or more portions of such system.

In utilizing the refuse feeder of the present invention, a control means is provided for interconnecting and operationally controlling the first drive means, the second drive means, and the pan drive means. The specific structure and installation of such a control means for providing the operational interactions to be described hereinbelow would be apparent to one skilled in the art and, therefore, it is believed unnecessary to give any specific description of such control system hardware.

In respect to the operation of the components of the present invention, however, the doors 12 are used for loading of the hopper 14 and doors 26 are used for controlling waste material to the conduit means 24. When the hopper is being filled, the second set of doors 26 are closed so as to seal the conduit means 24 from atmospheric entrainment of air through the open doors 12. When the hopper is empty a crane operator in a control room is signaled and the first set of doors 12 will automatically open for purposes of filling the hopper. The pan means 18 includes a selective weight setting for determining when the hopper is in a fully loaded condition. When the pan means senses a fully loaded condition, the doors 12 will automatically shut and the feeder apparatus will wait for a signal from the solid waste destruction system calling for additional supplies of waste material. Upon receiving such signal, the second door 26 will open and the pan drive means will become energized to feed waste material into the conduit means 24. The pan means and drive means, therefore, such as the Jeffrey Feeder referred to hereinabove, provides a generally uniform feeding of the waste material to the conduit means and upon receiving a signal from the furnace means that a sufficient supply of combustible waste material has been received, the second door means 26 closes and the pan means 18 ceases to operate. As previously described, when the pan means 18 has fed a predetermined amount of waste material to the conduit means 24, the first door means 12 will automatically open subsequent to closing of the second door means 26 for subsequent batch filling of the hopper.

As mentioned above, the third door means 30 can be selectively opened to provide alternative feeding directly into the conduit means 24 should the hopper 14 and associated first and second door means for some reason become inoperable. In addition, the third door means 30 provides automatic pressure relief in the event of an internal explosion and consequent excessive internal pressure within the waste disposal system.

From the foregoing, it is apparent that the objects of the present invention have been fully accomplished. As a result of this invention, a refuse feeder is provided which can be utilized in a variety of waste disposal systems. Of significant importance is the fact that waste materials can be uniformly fed to the gasification chamber of a destruction system and that minimum atmospheric air entrainment occurs due to the existence of the first and second door means as described hereinabove.

I claim:

1. A refuse feeder for a solid waste destruction system having a gasification chamber and conduit means for conveying solid waste materials to the gasification chamber in which the flame temperature of the waste materials is reached so as to reduce the waste materials to a molten condition with resulting gases and vapors being produced, and means for removing the molten waste material, resulting gases, and vapors from the system; said refuse feeder comprising:

a storage hopper means for receiving solid waste material wherein said storage hopper is adapted to communicate with said conduit means so as to urge waste material toward said conduit means, first sealing door means movable between open and closed positions and being mounted on said storage hopper, said first sealing door means being normally in a closed position to seal the interior of said storage hopper means from the ambient atmosphere and being in an open position for filing of said hopper means with waste material, and second sealing door means movable between open and closed positions and being mounted intermediate to said storage hopper means and said conduit means whereby said second sealing door means is in a normally closed position to seal said conduit means from said ambient atmosphere when said first sealing door means is in an open position.

2. A refuse feeder as set forth in claim 1 wherein said storage hopper means includes a pan means in the bottom portion thereof for urging waste material toward said conduit means.

3. A refuse feeder as set forth in claim 2 wherein said pan means is inclined towards said conduit means and includes a pan drive means for driving said pan means so that waste material is affirmatively urged towards said conduit means.

4. A refuse feeder as set forth in claim 2 further including a first drive means connected to said first sealing door means and a second drive means connected to said second sealing door means, both said drive means respectively driving said door means between open and closed positions.

5. A refuse feeder as set forth in claim 4 wherein said pan means includes a pan drive means for driving said pan means so that waste material is affirmatively urged towards said conduit means.

6. A refuse feeder as set forth in claim 5 including control means for operationally interconnecting and controlling said first drive means, said second drive means, and said pan drive means so that said second door means will be closed when said first door means is opened, and said pan drive means will selectively operate when said first door means is closed and said second door means is open.

7. A refuse feeder as set forth in claim 1 further including third sealing door means movable between open and closed positions and being mounted in an outer wall portion of said conduit means so that said third door means releases to an open position upon occurrence of excesive pressure within said conduit means.

8. A refuse feeder as set forth in claim 7 including a third drive means connected to said third door means for selectively driving said third door means between open and closed positions so that said third door means may be used as an alternative to said storage hopper means for transferring waste materials to said conduit means.

* * * * *